United States Patent [19]

Peterson

[11] 4,304,595

[45] Dec. 8, 1981

[54] METHOD OF MANUFACTURING CRUDE IRON FROM SULPHIDIC IRON-CONTAINING MATERIAL

[75] Inventor: Stig A. Peterson, Skelleftehamn, Sweden

[73] Assignee: Boliden Aktiebolag, Stockholm, Sweden

[21] Appl. No.: 24,652

[22] PCT Filed: Jul. 21, 1978

[86] PCT No.: PCT/SE78/00024

§ 371 Date: Mar. 22, 1979

§ 102(e) Date: Mar. 22, 1979

[87] PCT Pub. No.: WO79/00058

PCT Pub. Date: Feb. 8, 1979

[30] Foreign Application Priority Data

Jul. 22, 1977 [SE] Sweden ..... 7708462

[51] Int. Cl.[3] ..... C21B 13/14

[52] U.S. Cl. ..... 75/23; 75/30; 75/40

[58] Field of Search ..... 74/23, 30, 40

[56] References Cited

U.S. PATENT DOCUMENTS

| | | | |
|---|---|---|---|
| 3,326,671 | 6/1967 | Worner | 75/92 |
| 3,615,362 | 10/1971 | Warner | 75/75 |
| 3,725,044 | 4/1973 | Morisaki et al. | 75/74 |
| 3,790,366 | 2/1974 | Bryk et al. | 75/23 |
| 3,832,163 | 8/1974 | Themelis et al. | 75/72 |
| 4,088,310 | 5/1978 | Noponen et al. | 75/92 |
| 4,204,861 | 5/1980 | Petersson et al. | 75/73 |

FOREIGN PATENT DOCUMENTS

| | | | |
|---|---|---|---|
| 2006662 | 9/1970 | Fed. Rep. of Germany | 75/75 |
| 2166728 | 8/1975 | Fed. Rep. of Germany | 75/74 |
| 2710970 | 9/1977 | Fed. Rep. of Germany | 75/73 |
| 383900 | 4/1976 | Sweden | 75/74 |

*Primary Examiner*—M. J. Andrews

*Attorney, Agent, or Firm*—Stevens, Davis, Miller & Mosher

[57] ABSTRACT

A method of producing crude iron from sulphidic iron-containing material, where an iron sulphide containing material is charged to a furnace space and there, together with a silica containing material and oxygen, is smelted to an iron-silicate smelt during combustion of sulphidebound sulphur present, so that said smelt contains approximately 70–90% by weight iron calculated as iron (II) oxide. To the smelt is then added a reducing agent in a manner such that the iron content calculated as iron (II) oxide falls to approximately 60% by weight or lower in the presence of lime and/or other fluxing agents and that formed crude iron is separated. The iron content of the iron silicate smelt is then increased by adding further iron sulphide containing material and oxygen for smelting and reducing agent for another reduction.

10 Claims, 1 Drawing Figure

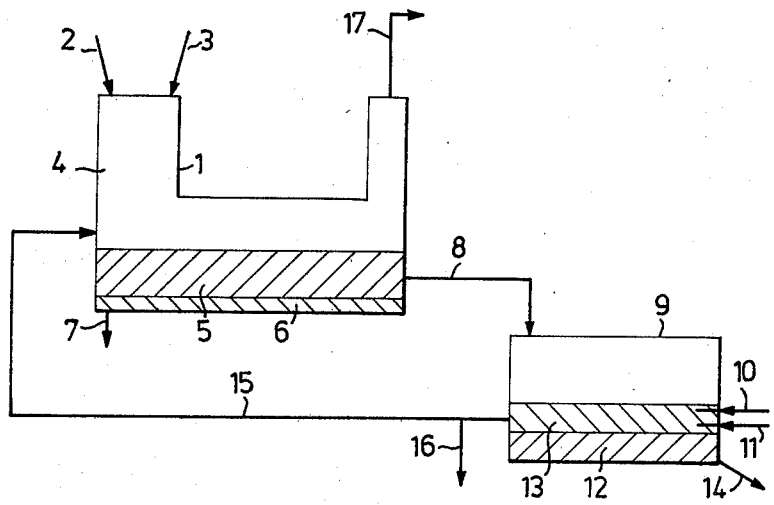
2
3
17
4
1
8
9
7
5
6
10
15
11
16
13
12
14

METHOD OF MANUFACTURING CRUDE IRON FROM SULPHIDIC IRON-CONTAINING MATERIAL

The present invention relates to a method of producing crude iron from sulphidic iron-containing material, preferably pyrite and pyrrhotite. Pyrite ($FeS_2$) is used mainly as a sulphur raw material in the manufacture of sulphuric acid and liquid sulphur dioxide, by combusting the sulphur content with an oxygen-containing gas during a so-called roasting operation. When the sulphur raw material is roasted, sulphur dioxide is formed, which is passed to a plant for the production of sulphuric acid or liquid sulphur dioxide. During said roasting operation the iron content of the pyrite is converted to iron oxide, which may be in the form of hematite or magnetite, or mixtures thereof, depending upon the roasting method used. Hitherto, the retail value of such iron oxides or pyrite cinders has been very low, mainly due to the fact that the cinders are extremely fine and create dust, and are therefore difficult to handle. Further, the quantities in which said cinders are produced in a conventional sulphuric acid plant are so small, in the order of magnitude of 100,000 tons/year, that it is not sufficiently rewarding for a sintering plant to be erected on the acid plant premises, in which sintering plant the fine-grain material could be formed into agglomerates of a size suitable for charging to blast furnaces for example. Moreover, the pyrite cinders may be slightly contaminated with such impurities as, for example, copper, zinc, lead, cobalt, nickel, arsenic, sulphur and noble metals. In the majority of cases the presence of such impurities is not desirable in the production of iron and steel. The impurities, primarily copper, zinc and arsenic, also make it expensive to deposit or to dump the cinders, since it must be ensured that these metals are not leached from the cinders, e.g. by rain water.

When pyrite cinders are included as raw materials in the production of steel, it is normal practice, for the purpose of reducing the level of impurities in the steel, to simply dilute the pyrite cinders with iron-ore-concentrates which do not normally contain these impurities, which means that valuable metals such as copper, nickel, cobalt and, in certain cases, also noble metals, cannot be recovered from the pyrite cinders.

During recent years various processes have been proposed which permit the pyrite cinders to be refined and to be agglomerated, thereby rendering them more suitable as iron raw material, whilst recovering other metal values at the same time. A normal method is to treat the cinders with chlorine or a chlorine-containing material, thereby to convert the impurities to chlorides which, by heating or leaching, can be separated and subsequently recovered. Processes of this type have many disadvantages; for instance the plants required therefor are expensive to operate, because of the high investment costs required and the considerable quantity of chemicals consumed, and because of the corrosion to which the apparatus involved are subjected. Further, the use of chlorine leads to additional costs in the protection of the environment. The economic viability of such chlorinating refining processes is also dependent upon relatively high contents of impurities and recoverable valuable metals.

The present invention relates to a method of producing crude iron from iron-sulphide containing material and is characterized in that the iron sulphide containing material is charged to a furnace space and is there, together with a silicate-containing material smelted in the presence of oxygen to form an iron-silicate melt during the simultaneous combustion of the sulphide-bound sulphur present in said material, there being obtained a melt containing approximately 70–90% by weight of iron, calculated as iron(II)oxide, whereafter there is added to said iron silicate melt a reducing agent, in a manner such that the iron content of the silicate melt, calculated as iron(II)oxide, falls to approximately 60% by forming crude iron which is then separated, whereafter the iron content is again increased by adding iron-sulphide containing material and oxygen for a renewed smelting and reducing agent for a further reduction process. The iron content in the silicate smelt can be reduced to 40% or even lower by adding lime and/or other fluxing agents.

Thus, the method according to the invention allows pyrite to be used directly, not only as a raw material for the production of sulphurdioxide and sulphurid acid, but also as a raw material for the production of iron, by charging the pyrite to a smelting furnace, such as a flash smelting furnace, for example, a furnace such as that described in the U.S. Pat. No. 3,790,366, together with silica, such as quartz sand, and are smelted autogenously by supplying to the furnace oxygen-gas or air enriched in oxygen, thereby to form substantially an iron silicate smelt. When large quantities of non-ferrous metals are present, it is possible with the aforementioned method to ensure that the combustion of sulphur is not carried to completion, so that non-ferrous metals having a greater affinity than iron has to sulphur will form a matte, such non-ferrous metals normally being present in the pyrite as impurities.

The matte has a higher specific gravity than the oxidic iron-silicate melt and is insoluble therein, and hence the matte can be readily separated from the melt and tapped-off. The major portion of the melt comprising iron oxide-silica also called fayalite-slag, and containing approximately 70–90% iron calculated as iron(II)oxide, is then used as raw material for the production of iron. The fayalite slag is reduced in molten form in a manner such as to reduce the iron content of the slag to approximately 60%, calculated as iron(II)oxide, or lower in the presence of lime and/or other fluxing agents in the slag with the aid of a reduction agent such as carbon, oil or a reducing gas, whilst simultaneously supplying oxygen during the forming and separating of a crude iron smelt. The heat generated during the autogenous smelting of pyrites can be utilized to smelt other raw materials, such as iron oxides, pyrite cinders, ferrous slags and leaching residues containing substantial quantities of iron.

Smelting to fayalite slag and the reduction of the same to form crude iron can be carried out in a continuous furnace. Advantages can be gained, however, by utilizing separate furnace units for the different process steps, such as smelting of the material in a flash smelter, whereafter the fayalite slag formed is transferred to a smelt reduction furnace for reduction. Among those advantages to be gained by using separate furnace units is the increased flexibility then made available, the possibility of using known and established techniques, and the possibility of arranging separate holding furnaces between the furnace units, for equilizing any variations occuring in the process. Further advantages can be gained by using separate furnace units to facilitate gas cleaning and process control. Fayalite slag having a reduced content of iron(II)oxide is then retuned from the reduction unit to the smelting furnace. By proceeding in the aforementioned manner, the silica will circulate in the process. The lower limit to which iron can be present in the slag, calculated as iron(II)oxide is governed by the fact that the activity of iron(II)oxide in the slag falls rapidly and the melting point rises greatly when the iron content is less than approximately 60% by weight, while the upper limit is governed by the fact that when there is more than approximately 90% iron in the slag, the content of iron(II)oxide, and therewith the extent to which magnetite is formed, is excessively high. Thus, prior to the reduction process, the slag must contain at least approximately 70% by weight iron, in order to obtain a satisfactory yield of crude iron from the slag during the reduction process. Suitable smelt-reduction processes are described, for example, in the German Pat. Nos. 508,966 and 1,458,752, and in an article in Kemisk Tidskrift No. 6, 1976 (Sweden).

Since in addition to containing heavy metals, pyrites normally also contain some ganque, 0.5–2%. Part of the slag, corresponding to the amount of $Al_2O_3$ which, inter alia, is incorporated in the gangue, must be tapped off so that no build up of gangue, inter alia, $Al_2O_3$, is obtained in the slag. This often means in practice that approximately 1–5% of the slag must be tapped off, it being possible to use this amount as additive material in, for example, blast furnaces.

The method according to the present invention enables sulphur dioxide and crude iron to be produced from pyrites and other ironsulphide containing materials in a favourable manner from the aspect of energy consumption and whilst simultaneously recovering any valuable non-ferrous metal present. Further, since most of the silica circulates in the process, the consumption of silica will be very low.

A further advantage afforded by the process according to the invention is that fine-grain ferrous materials can be charged to a flash smelter in the state it obtained upon being concentrated, which provides for considerable saving in comparison with, for example, shaft furnaces, in which only agglomerated, sintered iron raw-material can be used.

The method according to the invention also permits the temperatures to be kept relatively low during the process, for example in the range of 1250°–1350° C., which is favourable with respect to the furnace lining. When there is a risk of magnetite depositing on the walls of the furnace, the temperature should be increased by some hundred degrees.

So that the invention will be more readily understood the method will now be described with reference to an exemplary embodiment thereof illustrated in FIG. 1.

Pyrites are charged to a furnace 1 via a charging means 2 (indicated with an arrow) together with other iron raw materials, e.g. iron-ore concentrates of pyrite cinders, in the form of hematite or magnetite, in quantities such that the iron content of a liquid fayalite slag, which has been returned to the furnace 1 from the hereinafter described iron-reduction process step, is increased from approximately 60–63% FeO or in the presence of lime also from a lower percentage to approximately 70–90, preferably approximately 85% by weight FeO calculated as iron(II)oxide.

By adding oxygen, or air enriched in oxygen, through a line 3, the sulphur content of the pyrite is combusted and heat is developed in the shaft 4 of the flash smelter 1 in the process thereof, the added iron-sulphide containing material being smelted and forming a smelt bath 5 comprising mostly fayalite. As beforementioned, iron-sulphide containing material normally contains non-ferrous metals, such as copper, nickel and cobalt, which form a sulphide phase 6 in which any noble metals present in the material will also be found. The sulphide phase 6 is insoluble in the oxidic fayalite slag 5 and has a higher specific gravity than said slag, and hence it will settle on the bottom of the flash smelter 1 and can be tapped off through the line 7 at uniform intervals. Part of the arsenic, antimony and bismuth present will be driven off during the smelting process whilst part will be dissolved in the sulphide phase.

The iron-enriched slag containing $SiO_2$ and FeO is then transferred to a reduction furnace 9 through a line 8, in which furnace the crude iron is reduced in a conventional manner by smelt reduction, i.e. by introducing oxygen through a line 10 and a reduction agent such as carbon, oil, natural gas and the like, into the molten slag through a line 11. The reduced crude iron forms a layer 12 beneath the slag layer 13. The crude iron is tapped from the furnace through a tapping hole indicated by an arrow 14.

During the reduction process, it will be ensured that the iron content of the $SiO_2$-FeO-slag 13 is reduced to a lower limit of not more than 60%, or lower in the presence of lime whereafter the slag is returned, via line 15, as indicated by an arrow, to the flash smelter 1, after first tapping-off some slag through the line 16, in order to prevent a build-up of impurities in the slag.

The $SO_2$-containing gas generated during the flash smelting process is passed out of the furnace through a gas outlet 17 and is led to a sulphuric acid plant (not shown) or a plant (also not shown) for producing liquid sulphur dioxide, subsequent to subjecting the gas to a heat exchange process and cleaning the gas from dust in a conventional manner.

As previously mentioned the preferred iron-sulphide containing materials are pyrite and pyrrhotite. In addition, iron-containing material of an oxidic type, such as pyrite cinders and iron-ore concentrates can be added and smelted with the excess heat generated during the autogenous smelting of the sulphidic material. Because of the strongly reducing conditions prevailing during the smelt reduction process, any zinc present will be fumed off in the form of a metal vapor and can subsequently be recovered in a dust filter, subsequent to combusting the metal vapor to zinc oxide in a conventional manner. Thus, the process permits the non-ferrous metal content of the iron raw-material to be separated and recovered, the presence of such non-ferrous metal in the crude iron normally being undesirable.

If cinders containing Fe(III) obtained from conventional pyrite roasting processes are charged to the flash smelter, it should be ensured during the smelting process that magnetite is not formed in amounts greater than at most approximately 5 percent by weight of the total slag quantity. Magnetite namely has a higher melting point and will thus impart to the slag a very high viscosity, which renders the tapping of the slag difficult. By adding coke to the molten bath in the flash smelter, it is possible to create sufficient reducing conditions for the reduction of Fe(III) to Fe(II), so that the content of magnetite can be kept down.

The method according to the invention is also very advantageous from the energy aspect, since slag having a high iron content is charged to the smelt reduction furnace in molten form, so that the combustion heat generated by the pyrites can be used to a maximum. Further, the major part of the silica necessary for the process circulates in molten form.

When pyrites are burned in the presence of air, large quantities of excessive heat are generated, which heat can be used for smelting oxidic iron raw materials of the type previously mentioned. The amount of heat generated in this way can be considerably increased by using air enriched with oxygen, or 100% oxygen.

When 1000 kg pyrite are oxidized to form iron(II)oxide and sulphur dioxide, the heat of formation is 2174 MJ and 4750 MJ respectively. When adding $SiO_2$ in quantities such as to form the compound fayalite (2 $FEO.SiO_2$) the heat of formation is only 99 MJ.

The heat of formation for pyrite (pyrrhotite not included) is 1380 MJ per ton, which gives a net heat development for the process, when 100% oxygen gas is used of (2174+4750+99)-1380 MJ, which is equal to 5643 MJ per ton pyrite.

The output enthalpy for the products at 1300° C. can be calculated to approximately 1400 MJ per ton pyrite whilst taken into account the fact that the fayalite slag formed is returned to the process. Thus, when smelting in the aforementioned cases there is obtained a net heat surplus of approximately 4250 MJ, which surplus heat must be cooled away, preferably by adding and smelting non-sulphidic iron raw materials.

The method according to the invention enables pyrite concentrates to be used directly, both as raw materials for the recovery of sulphur dioxide and the recovery of iron. The main source of energy in the method according to the invention is the sulphur content in the pyrite concentrates, this sulphur being much less expensive than the higher grades of fuels, such as coal, coke, oil and gas. In addition to the sulphur fuel being inexpensive, the heat losses are lower than those experienced with conventional crude iron processes, since the silica contained in the slag is returned to the flash smelter in a molten state, and hence heat losses through the slag are substantially eliminated. A further and also important advantage is that finegrain iron raw materials can be used, which is not the case when producing iron in, for example, a shaft furnace, to which the material must be charged in the form of agglomerates.

Iron raw materials containing impurities such as Cu and Pb can be used in known processes only when they have been purified in a special process step or when the impurities are diluted by adding relatively large quantities of pure iron raw material. In this latter case, valuable metals can not be recovered.

EXAMPLE 1

1000 kgs of pyrite are smelted in a flash smelter with 1609 $Nm^3$ oxygen enriched air (31.7% oxygen) whereby an iron-rich oxidic slag with a temperature of 1450° C. and a composition of 80.0% FeO 20.0% $SiO_2$ was obtained.

The produced slag was transferred into a reduction furnace and reduced with 356 kgs of coke which were injected together with 241 $Nm^3$ oxygen gas whereby crude iron with 4% carbon by weight and a temperature of 1250° C. and thereupon a slag with 60% iron(II)oxide by weight were obtained.

EXAMPLE 2

In a flash smelter furnace 1000 kgs of pyrite ore with an approximate composition of 45% Fe
50% S
1.4% $SiO_2$
3.6% of CaO were smelted together with 1554 $Nm^3$ oxygen enriched air (31.7% oxygen by weight) whereby 813 kgs iron-rich oxidic slag with a temperature of 1450° C. and a composition of 81.2% FeO
12.5% $SiO_2$
6.3% CaO were obtained.

The produced slag was transferred into a reduction furnace and was reduced with 361 kgs of coke which were injected together with 258 $Nm^3$ oxygen gas whereby 438.5 kgs crude iron with 4 percent carbon by weight at a temperature of 1250° C. and 270 kgs of slag with the composition of 41.9% FeO
38.7% $SiO_2$
18.4% CaO were obtained.

Of said slag 179 kgs were recirculated to the flash smelter for recovery of its silica-content and heat-content in a following charge of pyrite ore, and 92 kgs of the slag were tapped off as a bleed.

I claim:

1. A method for producing crude iron from iron sulphide containing materials comprising charging the iron sulphide containing material to a furnace space, smelting the same together with a silica containing material and oxygen to an iron silicate smelt during combustion of sulphide-bound sulphur present, so that said smelt contains approximately 70–90% by weight iron calculated as iron (II) oxide, adding a reducing agent to said iron silicate smelt in a manner such that the iron content calculated as iron (II) oxide falls to approximately 60% by weight or lower in the presence of lime and/or other fluxing agents, separating crude iron formed, charging further iron sulphide containing material to the furnace space containing already formed iron silicate smelt and smelting the same by adding oxygen so that the iron content is again increased in the iron silicate smelt and adding a reducing agent for a further reduction in iron content.

2. A method for the production of crude iron from iron sulphide containing material according to claim 1, characterized in that surplus heat generated during the smelting process is utilized to smelt iron oxide material.

3. A method according to claim 2, characterized in that the iron oxide material comprises pyrite cinders.

4. A method according to claim 2, characterized in that the iron oxide material comprises iron ore concentrates.

5. A method according to claim 1, characterized in that smelting is effected in a flash smelter.

6. A method according to claim 1, characterized in that smelting is effected by adding oxygen or oxygen-enriched air.

7. A method according to claim 1, characterized in that smelting is carried out in a manner such that residual quantities of sulphur are sufficient to enable any present copper, nickel and cobalt with said sulphur to form a matte, which can be tapped off.

8. A method according to claim 1, characterized in that a minor part of the fayalite slag is tapped off after reduction, in order to prevent the formation of gangues.

9. A method for producing crude iron from iron sulphide containing materials comprising charging the iron sulphide containing material to a smelting furnace, smelting the same together with a silica containing material and oxygen to an iron silicate smelt during combustion of sulphide-bound sulphur present, so that said smelt contains approximately 70–90% by weight iron calculated as iron (II) oxide, transferring said smelt to a reduction furnace, adding a reducing agent to said iron silicate smelt in a manner such that the iron content calculated as iron(II) oxide falls to approximately 60% by weight or lower in the presence of lime and/or other fluxing agents, separating crude iron formed returning iron silicate smelt to said smelting furnace, charging further iron sulphide containing material to the smelting furnace and smelting the same by adding oxygen so that the iron content is again increased in the iron silicate smelt, and transferring said smelt to said reduction furnace to which is added a reducing agent for again reducing the iron content.

10. A method according to claim 9, characterized in that the reduction is carried out in a reduction furnace in which coal and oxygen are injected through lances or tuyeres.

* * * * *